US006772563B2

(12) United States Patent
Kuhn

(10) Patent No.: US 6,772,563 B2
(45) Date of Patent: Aug. 10, 2004

(54) MOBILE ACCOMMODATION UNIT IN CONTAINER FORM

(75) Inventor: Peter Kuhn, Wietmarschen (DE)

(73) Assignee: Wietmarscher Ambulanz & Sonderfahrzeug GmbH, Wietmarschen (DE)

( * ) Notice: Subject to any disclaimer, the term of this patent is extended or adjusted under 35 U.S.C. 154(b) by 0 days.

(21) Appl. No.: 10/126,492

(22) Filed: Apr. 19, 2002

(65) Prior Publication Data

US 2002/0179598 A1 Dec. 5, 2002

(30) Foreign Application Priority Data

Apr. 20, 2001 (DE) ..... 101 19 638

(51) Int. Cl.[7] ..... E04B 1/343

(52) U.S. Cl. ..... 52/67; 52/64; 52/79.1; 52/79.5; 52/79.7; 52/79.9; 296/26; 296/171; 296/175; 220/1.5; 220/1.6; 220/4.03; 280/238

(58) Field of Search ..... 52/64, 67, 79.9, 52/79.1, 79.5, 79.7; 296/26, 171, 175; 220/1.5, 1.6, 4.03; 280/638

(56) References Cited

U.S. PATENT DOCUMENTS

| | | | | | |
|---|---|---|---|---|---|
| 2,167,557 | A | * | 7/1939 | Stout | 52/69 |
| 2,842,972 | A | * | 7/1958 | Houdart | 74/422 |
| 3,719,386 | A | * | 3/1973 | Puckett | 296/26.13 |
| 4,534,141 | A | * | 8/1985 | Fagnoni | 52/68 |
| 4,955,661 | A | * | 9/1990 | Mattice | 296/171 |
| 5,090,749 | A | * | 2/1992 | Lee | 296/171 |
| 5,237,782 | A | * | 8/1993 | Cooper | 52/67 |
| 5,291,701 | A | * | 3/1994 | Delacollette et al. | 52/67 |
| 5,345,730 | A | * | 9/1994 | Jurgensen | 52/64 |
| 5,491,933 | A | * | 2/1996 | Miller et al. | 52/67 |
| 5,577,351 | A | * | 11/1996 | Dewald et al. | 52/67 |
| 5,620,224 | A | * | 4/1997 | DiBiagio et al. | 296/26.13 |
| 5,706,612 | A | * | 1/1998 | Tillett | 52/67 |
| 5,732,839 | A | * | 3/1998 | Schimmang et al. | 220/1.5 |
| 5,761,854 | A | * | 6/1998 | Johnson et al. | 52/69 |
| 5,966,956 | A | * | 10/1999 | Morris et al. | 62/259.1 |
| 6,052,952 | A | * | 4/2000 | Frerichs et al. | 52/64 |
| 6,116,671 | A | * | 9/2000 | Schneider | 296/26.01 |
| 6,224,126 | B1 | * | 5/2001 | Martin et al. | 296/26.01 |
| 6,266,931 | B1 | * | 7/2001 | Erickson et al. | 52/67 |
| 6,338,523 | B1 | * | 1/2002 | Rasmussen | 296/175 |
| 6,428,073 | B1 | * | 8/2002 | Blodgett, Jr. | 296/26.14 |

FOREIGN PATENT DOCUMENTS

| | | |
|---|---|---|
| DE | 44 29 927 A 1 | 11/1995 |
| DE | 195 26 585 A | 1/1997 |
| FR | 76 13247 | 5/1976 |

* cited by examiner

*Primary Examiner*—Brian E. Glessner
*Assistant Examiner*—Christy M. Green
(74) *Attorney, Agent, or Firm*—Lawrence G. Fridman

(57) ABSTRACT

A mobile accommodation unit in container form for use as mobile hospital or mobile control or command center or the like has a box-shaped main box element and at least one secondary box element. In a transport state, the secondary box element is telescoped into the main box element. For setting up an accommodation unit of increased floor area, the secondary box element can be pulled out of a lateral opening of the main box element. In order to provide a continuous floor surface, after the secondary box element has been pulled out, the main box element has a movable floor element, which can be lifted relative to a basic floor element so as to equalize the floor levels of the main box element and the secondary box element.

12 Claims, 13 Drawing Sheets

MOBILE ACCOMMODATION UNIT IN CONTAINER FORM

BACKGROUND OF THE INVENTION

The invention relates to a mobile accommodation unit in container form. The mobile accommodation unit comprises a box-shaped main box element which has a floor element and a ceiling and normally end and side walls. The main box element may have the standardized dimensions of a conventional container, though this is not necessary, and the dimensions of the main box element may be different from the standardized container dimensions. At least one secondary box element of smaller cross sectional area is provided. In a transport state, this secondary box element is retained within said main box element. This secondary box element can be pulled out of the main box element through a lateral opening of the main box element, in order to provide an accomodation unit of enlarged space and floor area for living or working.

Accommodation units in container form can be used for various purposes. Container can easily and quickly be transported to any desired location by truck, boat, rail, helicopter, airplane or other transport means. Their capacity of quickly providing rooms make the particularly adapted for emergency missions. Container can easily be used as mobile hospital with surgery facilities or as control center for catastrophe or emergency missions. They may also be used, for example, as a command center for military missions. Other applications are work rooms on construction sites, temporary classrooms or simply rooms to live in.

In order to be able to transport containers with conventional transport equipment, the containers are usually made with standardized dimensions. Often, the space available within such containers is not sufficient. It is well known, to place a plurality of such containers side-by-side or one on top of the other. It is possible to connect such containers. To this end, individual side walls of the containers may be removed. This procedure suffers from the disadvantage that a separate vehicle is required for the transport of each container. In some cases, for example if a mobile operating room or a mobile control center is to be established, a rather large, continuous floor area is required, which permits equipment to be installed easily accessible. Such floor areas are not provided by the dimensions of a standardized, mobile container. Often, such continuous floor areas cannot be obtained by modular combination of a plurality of separate containers. Firstly, erecting a construction with a plurality of containers requires quite some time. In addition, such construction will not yield a continuous floor surface of the desired size.

German patent 44 29 927 discloses a mobile accommodation unit in container form, which consists of a main box element and at least one secondary box element, which can be pulled out of the main box element on an open side thereof. A lifting device permits the secondary box element to be lowered, after it has been completely pulled out of the main box element, such that the floor of the secondary box element is lowered to the level of the floor of the main box element. Correspondingly, when retracting the secondary box element, the secondary box element has to be lifted to permit pushing it into the main box element.

A similar design is disclosed by German utility model 0 94 08 060.7. There, a lifting rail is provided, which can be extended from the main box element parallel to the secondary box element and permits the secondary box element to be lowered, in order to bring the floor of the secondary box element to the level of the floor of the main box element.

These prior art mobile accommodation units; suffer from the disadvantage that they are difficult to seal. In order to bring the floors to a common level, the secondary box element has to be removed completely from the main box element, and the the secondary box element has to be lowered as a whole. This results in rather large gaps between main box element and secondary box element. Such gap is difficult to seal. Such seal is, however, imperative, for example, for a sterile operation room. Furthermore, always the whole secondary box element has to be lifted or lowered. This necessitates an expensive an high-power lifting device. This is particularly true, if the secondary box element has heavy equipment such as an operating table fixedly installed therein.

U.S. Pat. No. 3,719,386 has an expansible caravan with a main box element and a secondary box element. The secondary box element is larger than the main box element mounted on a chassis and has no fixed floor. Thereby, the secondary box element can be pushed over the main box element, in the transport state. In the expanded state of use, the secondary box element is pulled laterally from the main box element. A floor for the secondary box element consists of two articulated halves and is folded up, in the transport state. In the state of use, the two halves are straight and close the secondary box element at the bottom.

DISCLOSURE OF THE INVENTION

It is an object of the invention to provide an accommodation unit in container form of the type mentioned in the beginning which permits a continuous floor level to be established after expansion of the secondary box element.

It is another object of the invention to provide an accommodation unit in container form of the type mentioned in the beginning wherein a continuous floor level can be achieved with a minimum of expenditure of equipment or power.

Furthermore, it is an object of the invention to provide an accommodation unit in container form of the type mentioned in the beginning which can easily be sealed.

To this end, the main box element, as means for equalizing the floor levels, has a movable floor element in addition to its basic floor element and means for lifting and lowering this movable floor element.

With such an arrangement, the secondary box element need not be lowered after being pulled out of the main box element. Rather remains the floor of the secondary box element at its floor level, which is higher because the secondary box element has to be movable into the main box element. The floor levels are equalized by appropriate lifting of the movable floor element of the main box element. There is no need, as with the prior art, to completely pull the secondary box element out of the main box element, in order to permit it to be lowered. Instead it is possible to retain the main box element-side edge of the secondary box element within the main box element. This facilitates sealing.

In order to further enlarge the floor area of the mobile accommodation unit in its expanded state, one embodiment of the invention provides a second secondary box element of smaller cross sectional area than that of the first secondary box element. In the transport state, the first secondary box element is retracted into the main box element on one side thereof through a first opening, and the second secondary box element is retracted into the first secondary box element on the opposite side through a second opening of the main box element. The first secondary box element has also a movable floor element which is vertically movable relative to a basic floor element such that the floor levels of both the main box element and of the first secondary box element can be equalized with the floor level of the second secondary box element by appropriate adjustment of the heights of the movable floor elements.

Also here, the floor level of the whole accommodation unit is determined by the highest floor level. Here, this is the floor level of the smallest, second secondary box element which has to be pushed into the first secondary box element, in the transport state. The floor levels of both the main box element and of the first secondary box element are equalized wit this highest floor level by appropriate adjustment of the respective movable floor elements.

Sealing means may be provided between the main box element and each of the secondary box elements. As already explained above, this is facilitated by the fact that main box element and secondary box element retain their relative positions in vertical and lateral direction and are only telescoped into or out of each other.

The sealing may be effected by providing seals between the edges of each lateral opening of the main box element and the secondary box element open towards the main box element along the edges of the secondary box element, such seals sealing the secondary box element in the expanded state relative to the main box element. Cooperating sealing members may be provided on the floor element or movable floor element of each secondary box element and on the movable floor element of the main box element, such sealing members providing a seal between the movable floor element of the main box element and the respective floor elements of the secondary box elements, when the movable floor element has been lifted to the level of the floor element or movable floor element, respectively, of the secondary box elements.

In another embodiment of the invention, again, a second secondary box element of smaller cross sectional area than the first secondary box element is provided. In the transport state, the first secondary box element is retracted into the main box element on one side through a first opening of the main box element, and the second secondary box element is pushed into the first secondary box element on the opposite side through a second opening in the main box element. Here, however, the first secondary box element has a floor element which can be coupled and de-coupled thereto or therefrom, respectively, and the floor level of which in its coupled state is identical with the floor level of the second secondary box element. In the transport state, the de-coupled floor element of the first secondary box element is supported by the movable floor element of the main box element. The movable floor element of the main box element is movable into a fully lowered position, into an intermediate position and into an extended or upper position. In the fully lowered position, the de-copled floor element of the first secondary box element supported thereby is positioned below the floor element of the second secondary box element. In the intermediate position of the movable floor element, the floor element of the first secondary box element is lifted to the floor level of the second secondary box element and can be coupled to the first secondary box element. In the extended or upper position, after both secondary box elements have been expanded or pulled out, the movable floor element of the main box element is lifted to the common floor level of the two secondary box elements.

The height-adjustable movable floor element of the main box element has two functions: Firstly, it forms the floor of the main box element at the same floor level as the floors of the two secondary box elements. Secondly, it serves for lowering the de-coupled floor element of the first, larger secondary box element, such that the second, smaller secondary box element can be shifted into the first secondary box element for the transport state. This permits providing the floor levels of the two secondary box elements in one plane from the beginning.

In the transport state, the secondary box elements are telescoped into the main box element. The floorelement of the first secondary box element is de-coupled therefrom and is supported by the movable floor element of the main box element, the movable floor element being in its fully lowered position. Therefore, the second secondary box element could betelescoped into the first-floor-less-secondary box element without being impeded by the floor element thereof. In order to erect the accommodation unit, at first, the second secondary box element is retracted from the central main box element. The second secondary box element determines the floor level of the accommodation unit. Then, the movable floor element of the main box element is moved by appropriate lifting means into its intermediate position. In this intermediate position, the floor element of the first secondary box element engages the lower edge of the first secondary box element. In this position, the floor level of the first secondary box element is identical with that of the second secondary box element. The floor element is coupled with the first secondary box element. The first secondary box element with the floor element coupled thereto is retracted out of the main box element. Finally, the movable floor element is moved into its extended or upper position, in which the movable floor also is at the floor level of the two secondary box elements.

With such an arrangement, only one hight-adjustable floor element needs be provided, even if two secondary box elements are used.

The coupling of the floor element with the first secondary box element can be effected in the following way: Downwards extending locking bolts having tapered tips are provided along the lower edges of the end walls of the first secondary box element and are vertically movably guided in bushings. Locking balls are retained in lateral openings of the bushings. The floor element of the first secondary box element, which is adapted to be coupled and de-coupled to the first secondary box element, has annular looking members, which have recesses in their inner wall. When the floor element is lifted to engage the first secondary box element, the locking members are shifted over the bushings and locking bolts. The locking bolts can be displaced downwards in the bushings by means of a cam structure, which extend along the lower edges of the first secondary box element. The locking balls are urged radially outwards by the locking bolts and partially extend into the recesses of the locking members. The de-coupling is effected by means of the cam structure in reverse.

The floor elements of the box elements may be guided by rollers, when they are contracted or expanded.

Two embodiments of the invention are described hereinbelow with reference to the accompanying drawings.

DESCRIPTION OF PREFERRED EMBODIMENTS

Figure 1:
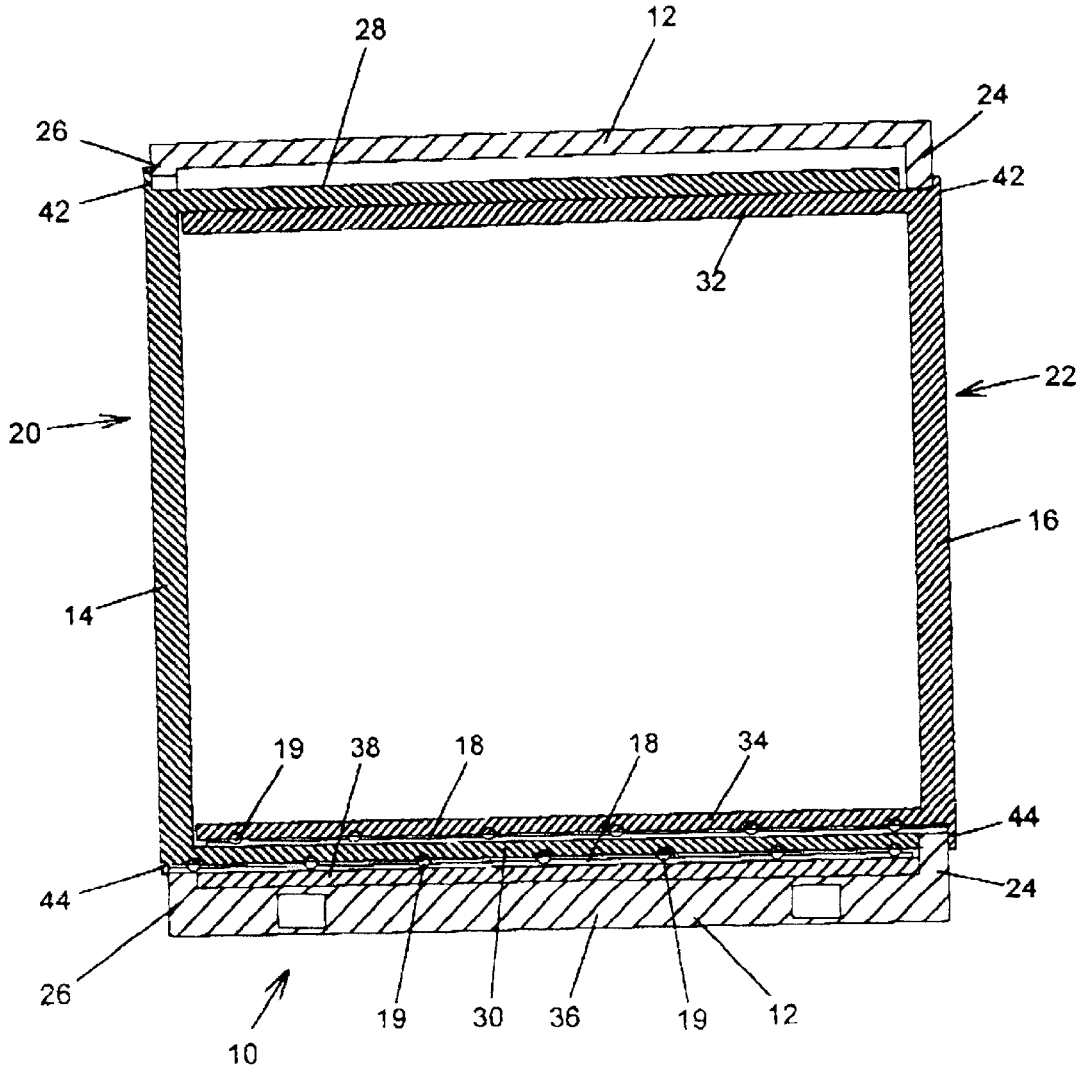
FIG. 1 is a schematic, vertical sectional view of a first embodiment of an accommodation unit in container form.
Figure 2:
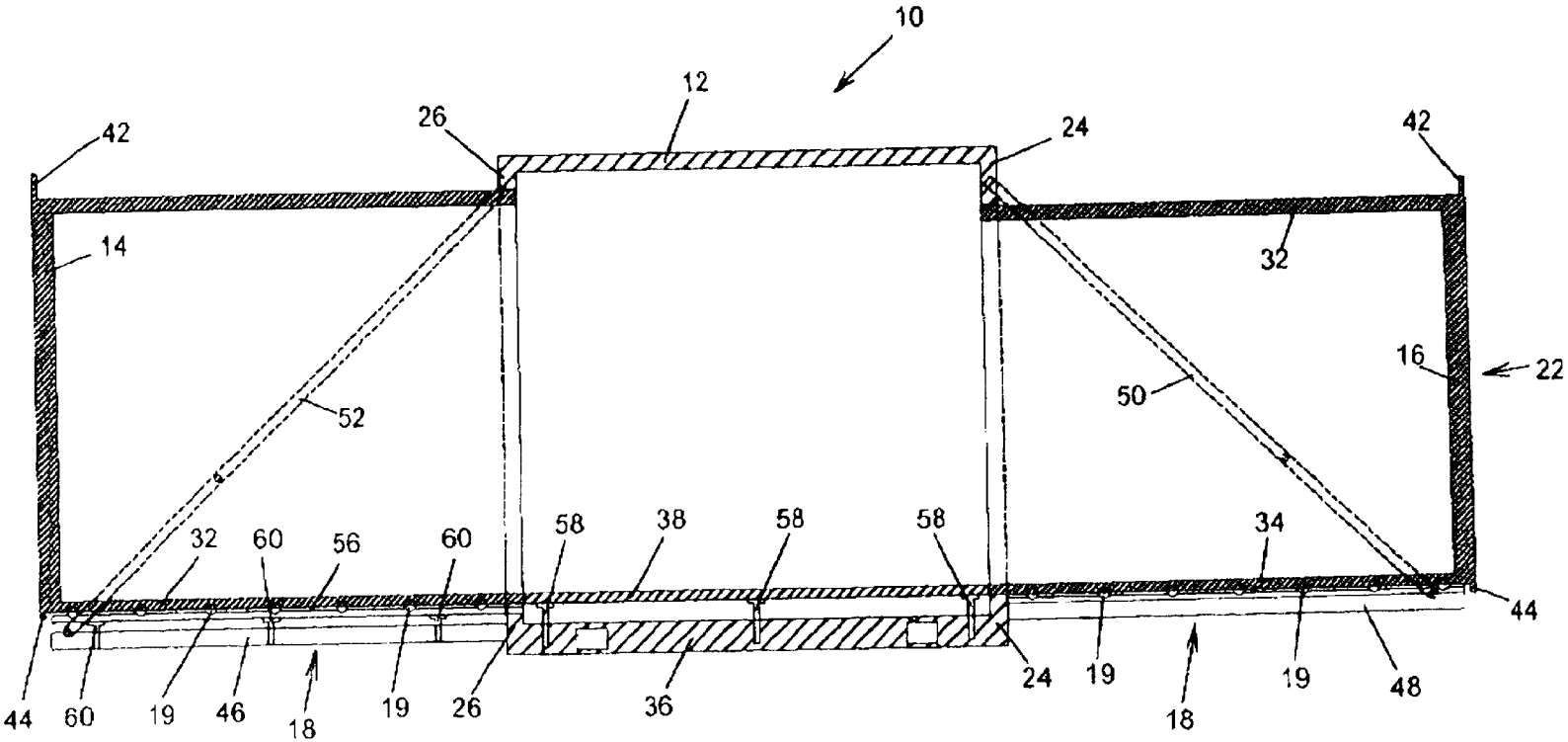
FIG. 2 is a schematic, vertical sectional view of the accommodation unit of FIG. 1 in expanded state.

Referring to FIG. 1, numeral 10 designates an accommodation unit in container form. In its transport state, the accommodation unit 10 is a box-like unit, which is shown in FIG. 1 in a vertical sectional view. In its retracted state as shown in FIG. 1, the accommodation unit has the dimensions of a conventional, standardized container. The accommodation unit 10 consists of a main box element 12, a large, first secondary box element 14 and a small, second secondary box element 16. The secondary box elements 14 and 16 are open on one side towards the main box element 12 and are also box-like. The main box element and the secondary box element may have doors, windows, locks and the like. These elements are not shown in FIG. 1 for clarity. The main box element 12 and the secondary box elements 14 and 16 are marked by different types of hatching. The main box element 12 has rectangular openings 20 and 22 in opposite side walls. The secondary box element 14 and 16 can be moved out of the main box element 12 through the openings 20 and 22, respectively, by means of a guiding system 18, as illustrated in FIG. 2. In FIGS. 1 and 2, only rollers 19 of the guiding system can be seen.

Numerals 24 and 26 designate the rims of the openings 20 and 22, respectively. The inner edges of the rims 24 and 26 sealingly engage the respective side walls, ceilings and floor elements 32 and 34, respectively, of the secondary box elements 14 and 16, respectively. In the retracted transport state, Flanges 40 and 42 of the secondary box elements 14 and 16, respectively, engage the outer surfaces of the rims 24 and 26, respectively, and provide an additional seal for the whole retracted container.

A further, movable floor element 38 is ürovided above the floor element 36 of the main box element 12. Also the larger, first secondary box element 14 has a movable floor element, which is height-adjustable relatibe to the floor element 32 of the secondary box element 14.

In FIG. 2, the secondary box elements 14 and 16 are expanded or moved out of the main box element 12. To this end, the secondary box elements 14 and 16 are guided by the guiding system 18. The guiding system 18 includes guide rails 46 and 48, which are provided in pairs and can, for example, retracted into or pulled out from housings (not shown) of the main box element 12. Furthermore, the guiding system 18 has supporting beams 50 and 52, which can be attached, at their one ends, to the side walls of the main box element 12 in the area of the rims 24 and 26, respectively, and, at their other ends, to the outer ends of the guide rails 46 and 48, respectively. When the secondary box elements 14 and 16 are expanded or moved out, they roll on the guide rails 46 and 48 through the rollers 19. The pairs of guide rails 46 and 48 are interconnected by a longitudinal string piece 54 (FIG. 4) each. The rollers of the secondary box elements 14 and 16 engage a detent device (not shown) to limit their outward movement.

In the present embodiment, the floor element 34 of the small secondary box element 16 has the highest floor level. Both the movable floor element 38 of the main box element 12 and the movable floor element 56 of the large secondary box element 14 are lifted to the floor level of the floor element 34 of the small secondary box element by means of lifting devices 58 and 60, respectively. Thereby, a continuous, plane floor is obtained throughout the whole floor area of the accommodation unit 10.

Figure 3:
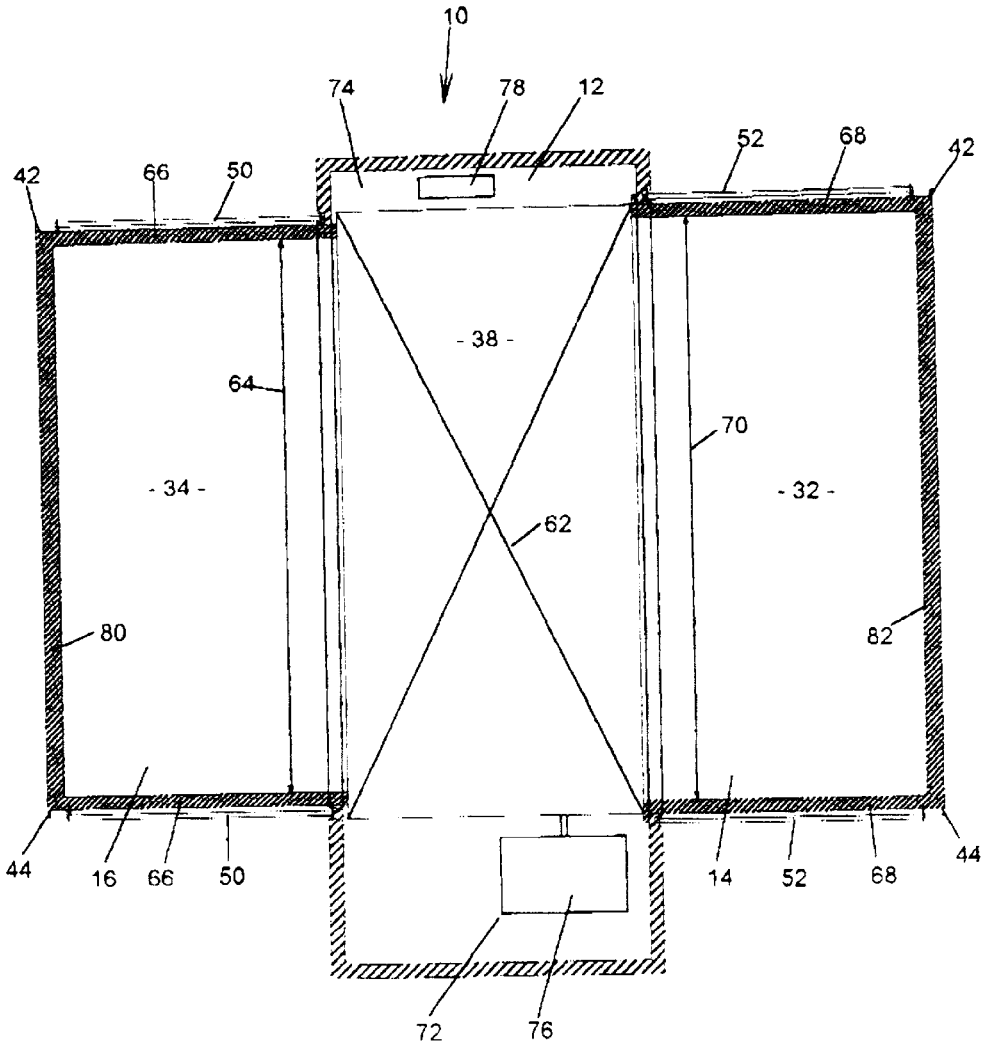
FIG. 3 is a plan view of the accommodation unit of FIGS. 1 and 2 in its expanded state.

FIG. 3 is a plan view of the accommodation unit 10. The movable floor element 38 of the main box element 12 is idicated by a cross 62. The spacing 64 between the end walls 66 of the small secondary box element 16 is selected such that the small secondary box element 16 can be telescoped directly between the end walls of the large secondary box element 14. The spacing 70 between the end walls 68 of the large secondary box element 14 is dimensioned accordingly. The main box element 12 may have areas 72 and 74 which are not covered by the movable floor element 38. These areas 72 and 74 may, for example, be used for the drive unit 76 driving the movable floor element 39 or for a air conditioning installation 78. In FIG. 3, these elements are illustrated merely as boxes.

It can be seen from FIG. 3, that fixedly installed furniture such as control panels, medical cupboards or the like can be mounted substantially only on the side walls 82. Operation tables or desks can be accommodated in the small secondary box element 16.

Figure 4:
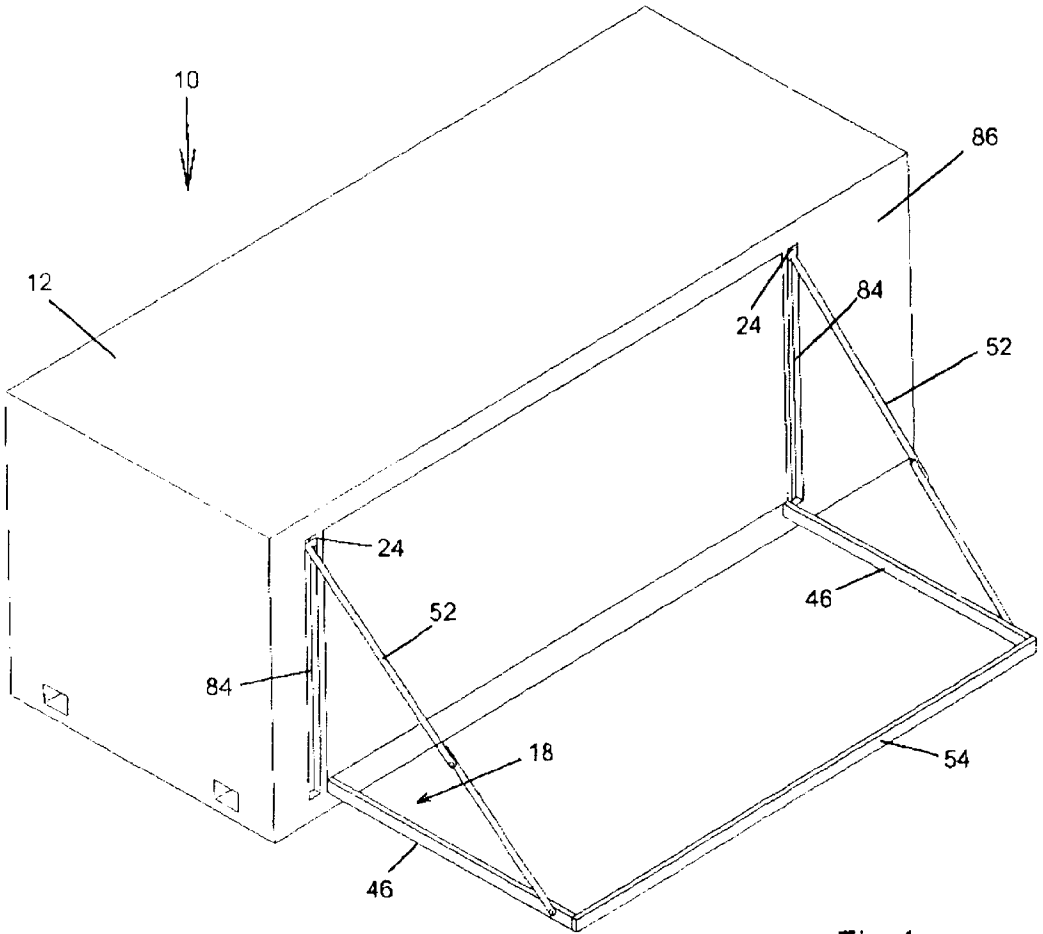
FIG. 4 is a perspective illustration of a main box element wit a guiding system for a secondary box element being in ist operative position.

FIG. 4 is a schematic, perspective view of the main box element 12 with the guiding system 18.

In the transport state, the support beams 52 are unhooked from the guide rails 46 and are accommodated in housing recesses 84 of the side wall 86 of the main box element.

FIGS. 5 to 12 illustrate a second embodiment of an accommodation unit in container form with expandable secondary box elements.

Figure 5:
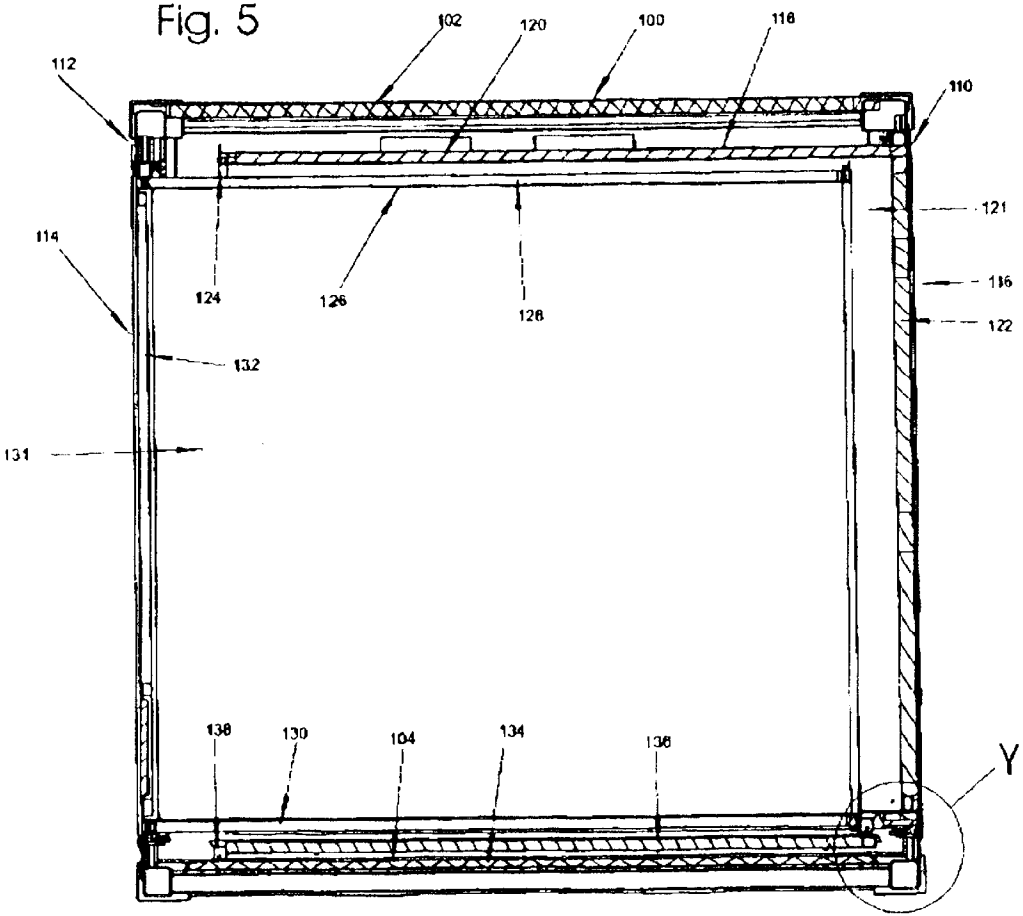
FIG. 5 is a vertical sectional view of a second embodiment of an accommodation unit in container form, in its transport state.

FIG. 5 shows the accommodation unit in its transport state, two secondary box element being telescoped in a main box element.

Figure 8:
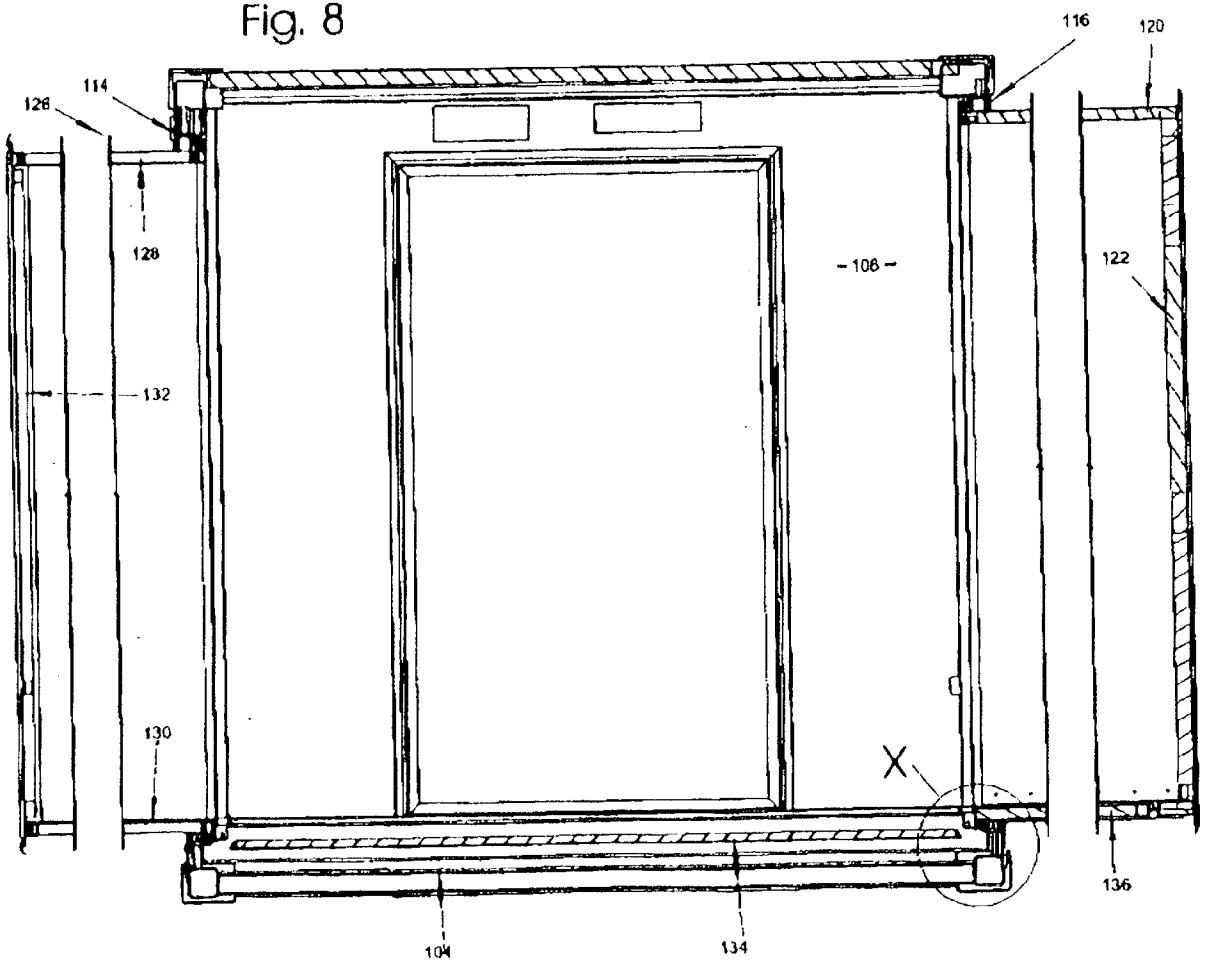
FIG. 8 is a vertical sectional view similar to FIG. 7 with the larger, first secondary box element, after its floor element has been coupled therewith, being moved out of the main box element.
Figure 9:
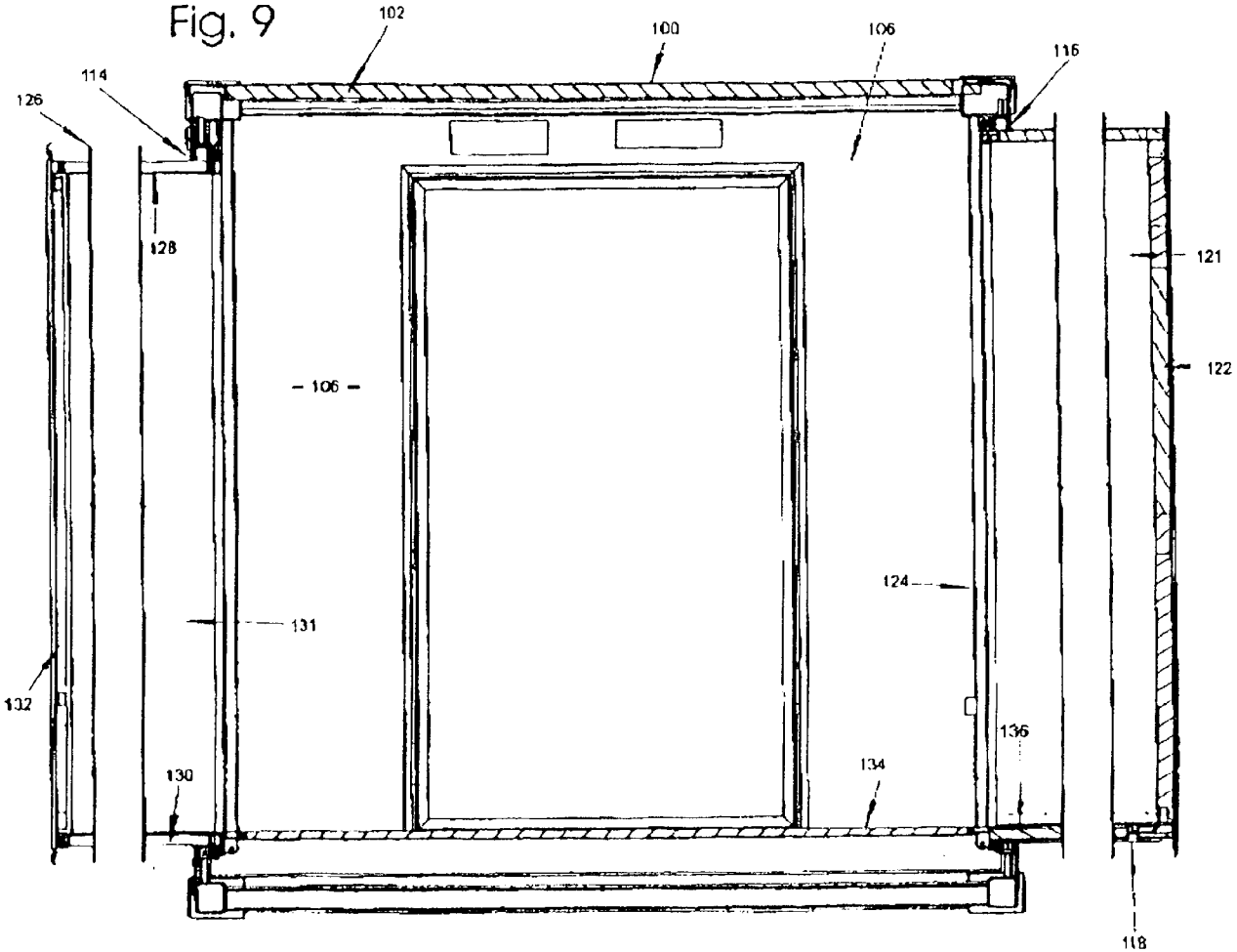
FIG. 9 is a vertical sectional view of the accommodation unit in its expanded state of use, the movable floor element of the main box element has been lifted to its expanded or upper position and is at the same floor level as the two secondary box elements.

Referring to FIG. 5, numeral 100 designates a container-like main box element. The main box element 100 has a roof 102 and a floor element 104. Roof 102 and floor element 104 are interconnected by end walls parallel to the plane of the paper of FIGS. 5 to 9. In FIGS. 8 and 9, only one end wall 106 with a door is visible. Rectangular openings 114 and 116 are provided in opposite side walls 110 and 112, respectively.

A larger, first secondary box element 118 is telescoped in the main box element 100. The secondary box element 118 has a roof 120, end walls 121 and 123, of which only the rear end wall 121 is visible in FIG. 5, and a side wall 122. In FIG. 5, side wall 122 closes the opening 116. The first secondary box element 118 is open on the side opposite the side wall 122 and defines an opening 124. In the transport state of FIG. 5, the first secondary box element also has no floor.

A smaller, second secondary box element 126 is telescoped in the first secondary box element 118. The second secondary box element 126 has a roof 128, a floor element 130, end walls, of which only the rear end wall 131 is visible in FIG. 5, and a side wall 132. In the transport state of FIG. 5, the side wall 132 closes the opening 124 of the first secondary box element 118.

The main box element 100 has a movable floor element, which can be lifted relatve to the "basic" floor element 104 by a lifting device (not shown). The lifting device may comprise one or more hydraulic jacks or my other type of lifting device well-known to a person skilled in the art. The movable floor element 134 can be moved to a lowered position by the lifting device, as illustrated in FIG. 5, to an intermediate position and in an extended or upper position. A floor element 136 appertaining to the first secondary box element 118 is supported on the lowered movable floor element 134. This floor element 136 can be coupled with the lower edges of the end walls of the—in FIG. 5 floor-less—first secondary box element 118, as will be described below.

As can be seen from FIG. 5, the floor element 136 is supported on the movable floor element 134 through rollers 138.

In this transport state, the accommodation unit has the standardized dimensions of a container and can be transported by conventional transport equipment such as a truck.

Figure 6:
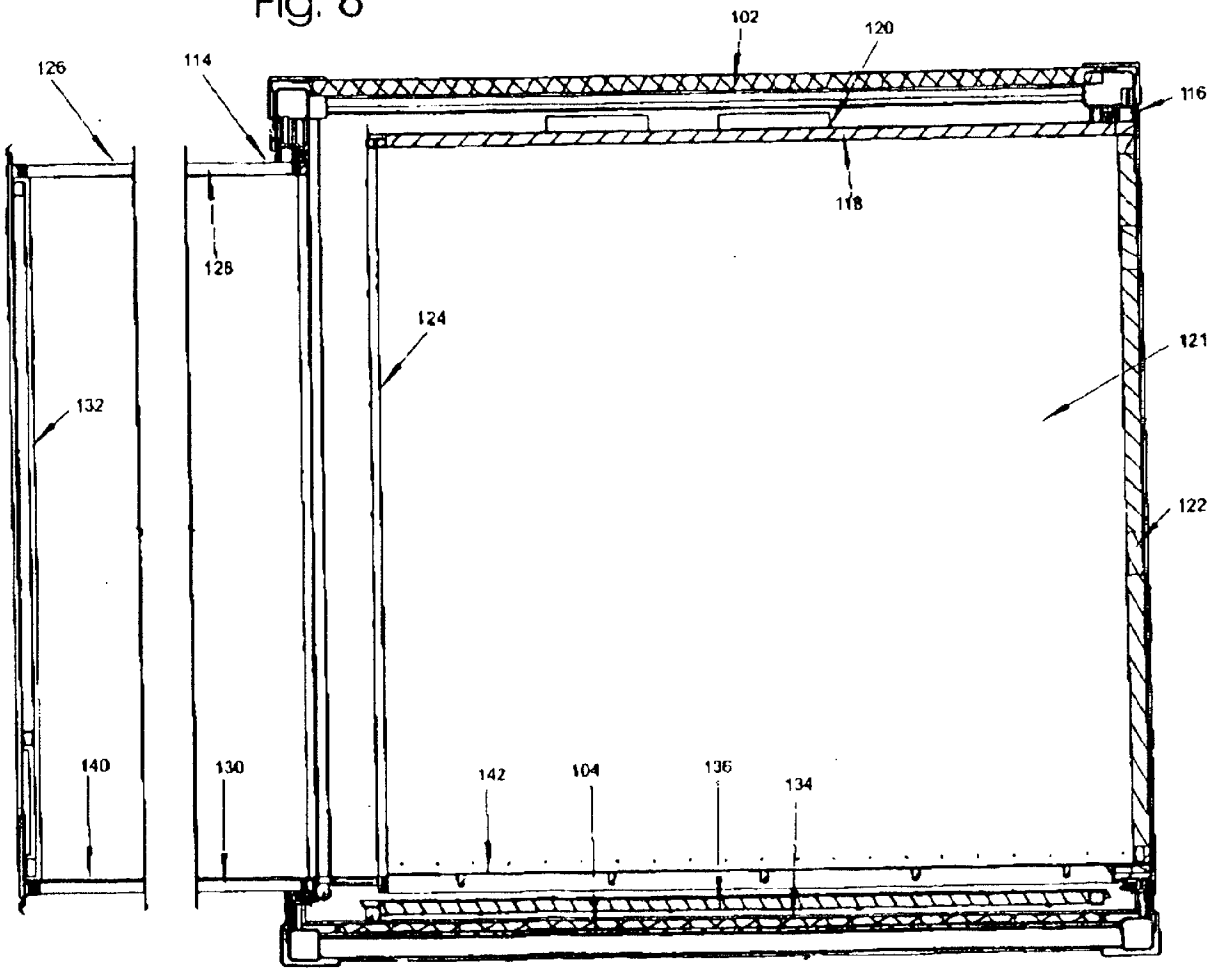
FIG. 6 is a vertical sectional view of the accommodation unit similar to FIG. 5 after the smaller, second secondary box element has been moved out, the floor element of the first secondary box element still being supported by the movable floor element of the main box element, the latter floor element being in its lowered position.

In order to set up the expanded accommodation unit, at first, the smaller, second secondary box element 126 ist pulled out to the left in FIG. 5, as illustrated in FIG. 6. The floor element 130 with its inner or upper surface 140 determines the floor level of the whole accommodation unit. The lower edges 142 of the end walls 121 and 123 of the first secondary box element 118 lie in the plane of the inner surface 140.

As the next step, the movable floor element 134 of the main box element 100 is lifted to its intermediate position. Thereby, the movable floor element 134 also lifts the floor element 136 supported thereon and brings it into engagement with the lower edges 142 of the end walls 121, 123. The floor element 136 is coupled with the end walls 121 and 123 by a locking device to be described below.

In this state, the inner surface of the floor element 136 of the first secondary box element 118, i.e. the floor level, lies in the same plane as the inner surface 140 of the second secondary box element 126.

Figure 7:
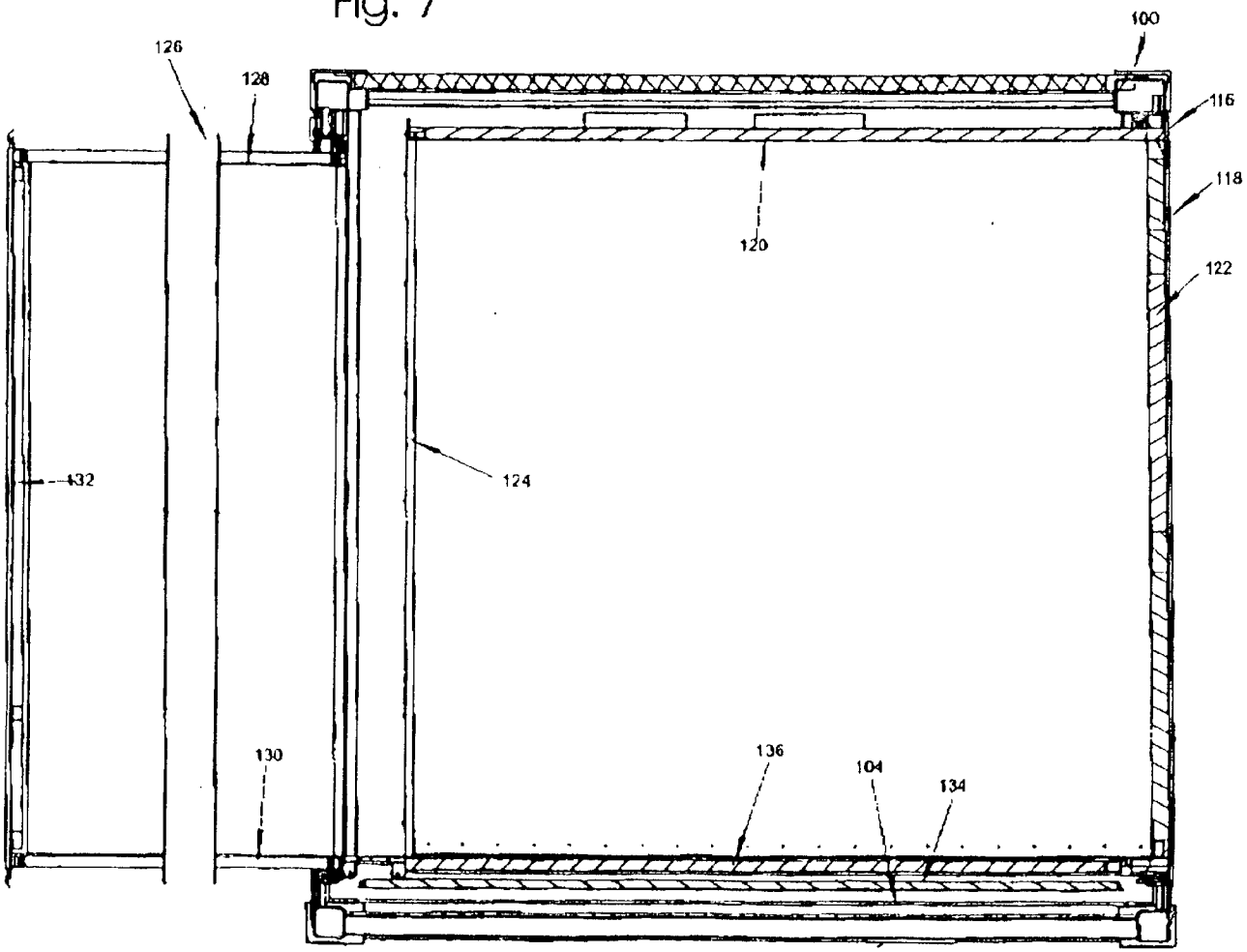
FIG. 7 is a vertical sectional view similar to FIG. 6, with the movable floor element of the main box element being lifted to its intermediate position and the floor element of the larger, first secondary box element engages the lower edges of the first secondary box element, such that the floor element of the first secondary box element can be coupled with these lower edges.

Then the first secondary box element 118 is telescoped to the right in FIG. 7. This is illustrated in FIG. 8.

In a final step, the movable floor element 134 of the main box element 100 is then lifted to its extended or upper position. In this position, the surface 144 of the movable floor element 134 lies at the same floor level as the inner surfaces 140 and 142 of the floor elements 130 and 136 of the two secondary box elements 126 and 118, respectively.

Figure 10:
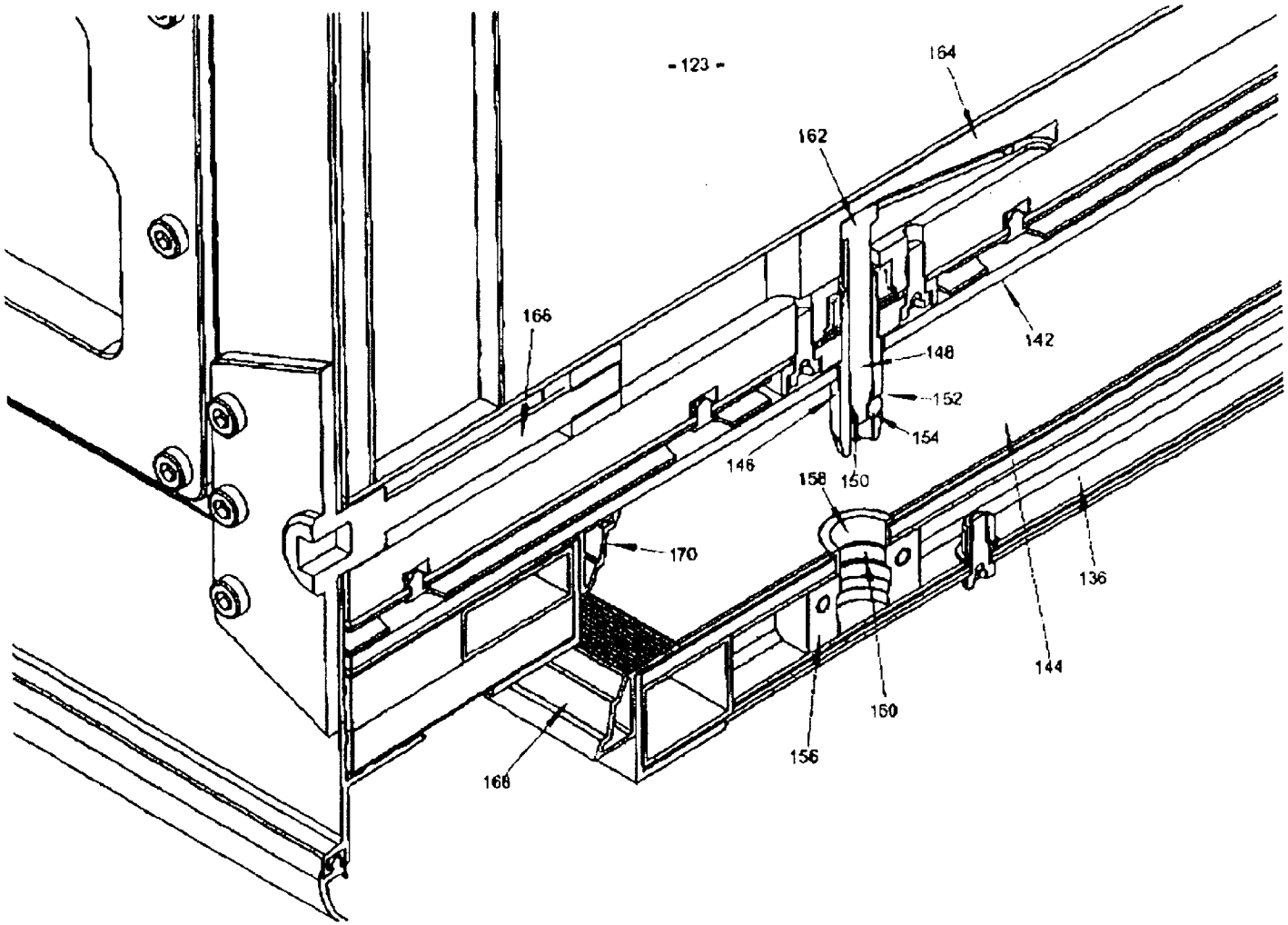
FIG. 10 is a perspective view of the locking mechanism, by means of which the floor element of the first secondary box element can be coupled with the end walls of this secondary box element.
Figure 11:
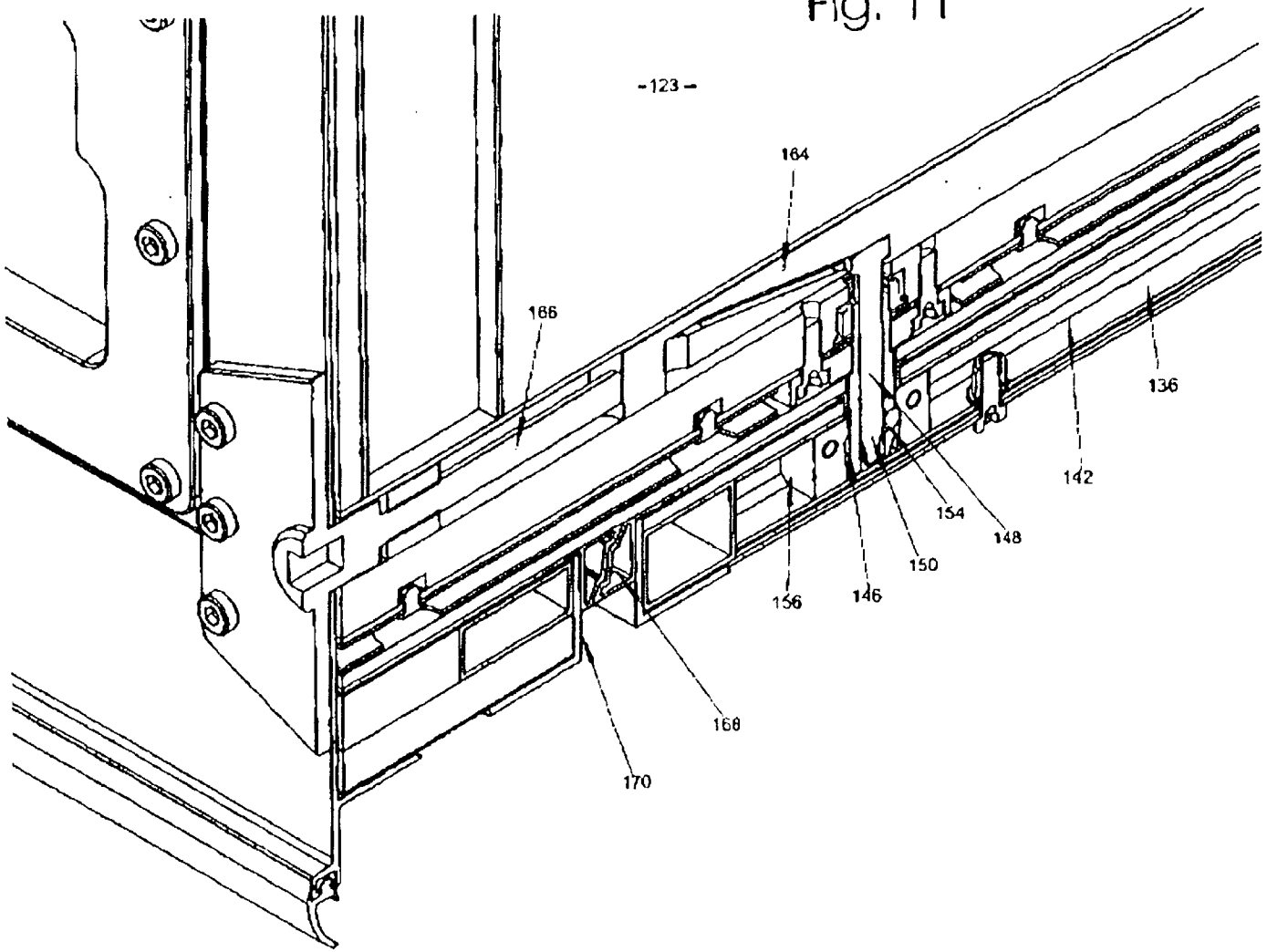
FIG. 11 is a perspective view of the locking mechanism similar to FIG. 10 with lifted and coupled floor element.

FIGS. 10 and 11 illustrate the coupling of the floor element 136 to the end walls 121 and 123 of the first secondary box element 118.

Downwards extending bushings 146 are provided at the lower edges of the end faces 121, 123 of the first secondary box element 118. Downwards extending locking bolts 148 are slidably guided in the bushings 146. The locking bolts 148 have tapering tips 150. The bushings have lateral openings 152. Locking balls 154 are guided in the lateral openings 152.

The floor element 136, adapted to be coupled to or de-coupled from the secondary box element 118 has annular locking elements 156 in alignment with the bushings 146. The annular locking elements 156 form a bore 158 with an inner wall. The bushings 146 can be inserted into the bore 158. In their inserted states, the bushings 146 are laterally guided in the bores 158, as can be seen best from FIG. 11. The inner wall of each bore 158 has a circumferential groove 160. When the bushing 146 has been inserted into the bore 158, the lateral openings 152 of the bushing 146 lie at the level of the circumferential groove 160.

The locking bolts 148 have an enlarged head 162. The head 162 is guided in a groove of a cam structure 164. The cam structure 164 is adjustable along the lower edge 142 by means of an adjusting spindle 166. In the position of FIG. 10, the locking bolt 148 is retracted. The tapering tip 150 permits the locking balls to yield radially inwards. Then the bushing 146 can be inserted into the annular locking element 156. If the cam structure 164 is shifted to the front left in FIGS. 10 and 11, the locking bolt 148 will be pushed downwards. The the locking bolt 148 urges the locking balls 156 radially outwards partly into the circumferential groove and prevents yielding of the locking balls 156 radially inwards into the openings 152. In this way, the floor element 136 is coupled with the lower edges 142 of the end walls 121 and 123 of the first secondary box element 118.

As can be seen from FIG. 11, a sealing profile 168 of the floor element 136 extends longitudinally to the first secondary box element 118, i.e. from front right to the rear left in FIGS. 10 and 11, is caused, thereby, to engage a sealing profile complementary thereto of the first secondary box element 118.

Figure 12:
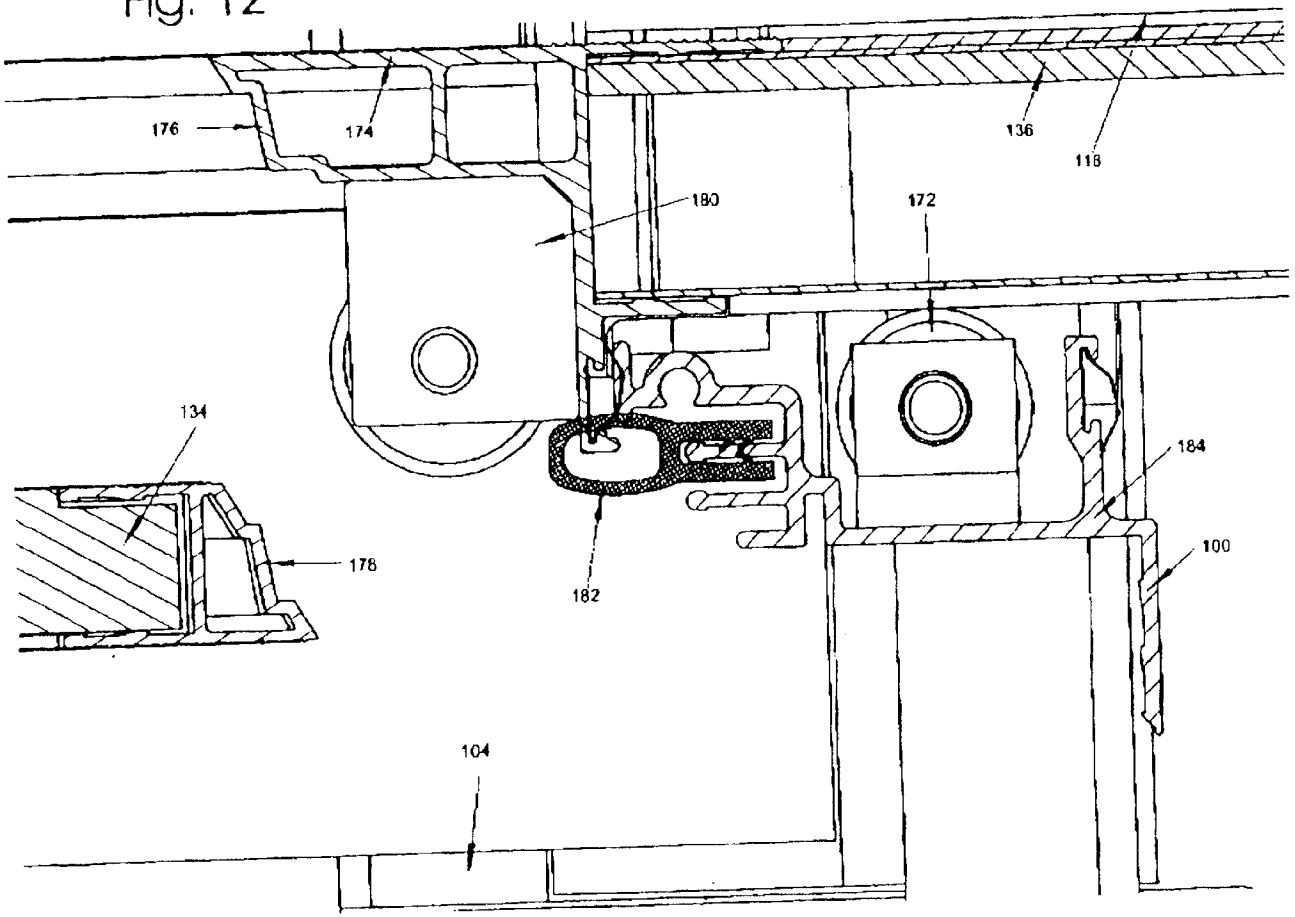
FIG. 12 shows a detail "X" of FIG. 8 at an enlarged scale, and illustrates the sealing with fully extended first secondary box element.

FIG. 12 illustrates the guiding and sealing of the first secondary box element 118 in the main box element 100, when the secondary box element 118 has been fully expanded.

The floor element 136 of the first secondary box element 118 is guided on rollers 172, which are provided on the main box element 100 at the lower edge of the opening 116. A profile 174 extending into the main box element 100 is integrally provided at the inner edge of the first secondary box element 118. This profile 174 forms a sealing ledge 176. The sealing ledge cooperates with a sealing ledge 178 complementary thereto of the movable floor element 134. Thereby, the floor elements 136 and 134 engage sealingly.

An all-around profile 180 at the inner end of the first secondary box element 118 cooperates with a seal 182 extending also all around the opening 116. The seal is provided on a profile 184 of the man box element 100 extending all around the opening 116. This profile also carries bearings for the rollers 172. As the secondary box element 118 is telescoped out of the main box element 100 without relative change of hight, the sealing between main box element 100 and first secondary box element 118 around opening 116 presents no problems.

Figure 13:
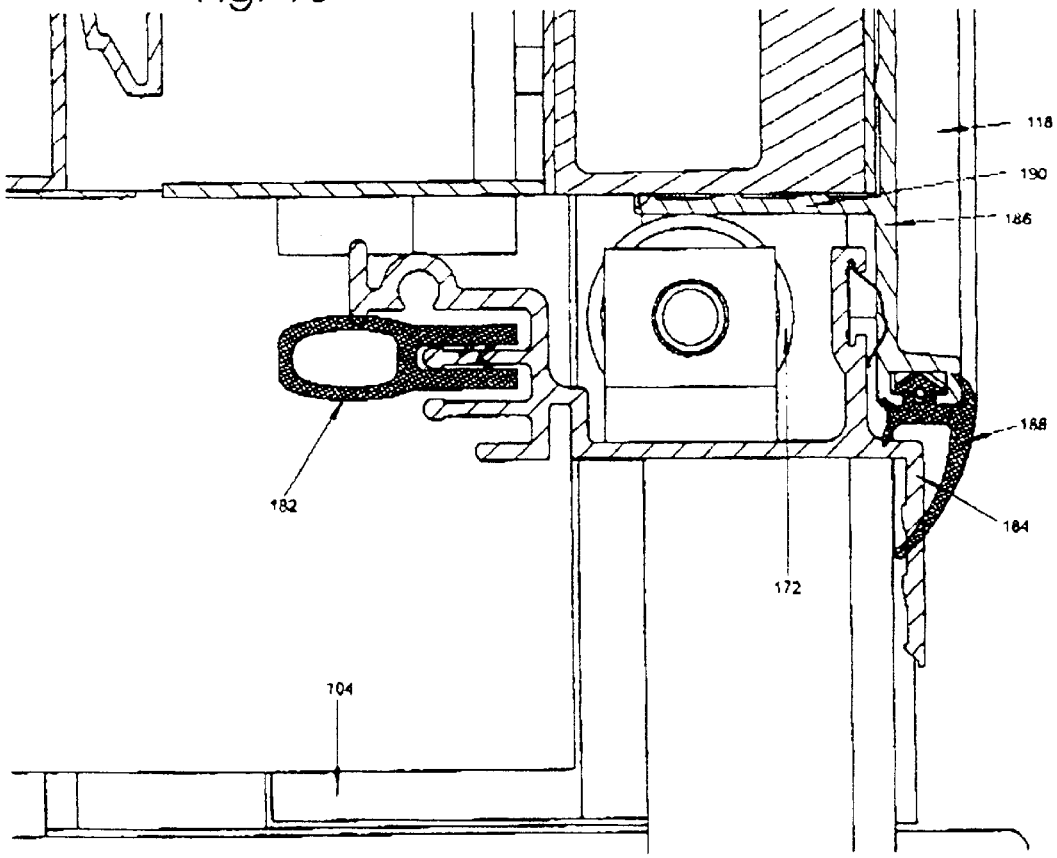
FIG. 13 shows a detail "Y" of FIG. 5 at an enlarged scale.

FIG. 13 shows a detail "Y" of FIG. 5 at an enlarged scale. FIG. 13 shows virtually the same location as FIG. 12, however in the transport state with retracted first secondary box element 118. A profile 196 extending all around the side wall 122 is provided at the outer end of the first secondary box element 118. The profile 186 holds a seal 188 also extending all around the side wall 122. In the transport slate, this seal sealingly engages the profile 184 of the main box element 100. In addition, the profile 186 bas a horizontal bracket 190, on which roller 172 is supported.

I claim:

1. A container-type mobile accommodation unit adapted for conversion from a retracted transportation state to an expanded state and visa versa, said unit comprising:

a main box element formed with at least a ceiling, a basic floor and a movable floor movable with respect to said basic floor, arrangement for lifting and lowering said movable floor relative to said basic floor, said main box element having at least one lateral opening; and at least one secondary box element having a basic floor, whereby in the transportation state the secondary box element is being contained within the main box element, to achieve said expanded state said secondary box element being guided for movement out of said main box element, so that in the expanded state a level of the movable floor of the main box element and a level of the basic floor of the at least one secondary box element are substantially identical, while a level of said basic floor of the main box element remains stable, so as to form in said expanded state an enlarged room with an increased continuous floor area.

2. A mobile accommodation unit as claimed in claim 1, wherein sealing arrangements are provided between said main and secondary box elements.

3. A mobile accommodation unit as claimed in claim 2, wherein said at least one secondary box element comprises first and second secondary box elements, first sealing arrangements are provided between said first secondary box element and said main box element at a first opening, said first sealing arrangements being adapted for sealing said first secondary box element relative to said main box element in said expanded state; second sealing arrangements are provided between said second secondary box element and said main box element at a second opening, said second sealing arrangements being adapted to seal said second secondary box element relative to said main box element in said expanded state.

4. A container-type mobile accommodation unit as claimed in claim 1, wherein said secondary box element is being guided for movement out of said main box element through the lateral opening.

5. A container-type mobile accommodation unit adapted for conversion from a retracted transportation state to an expanded state and visa versa, said unit comprising:

a main box element formed with at least a ceiling, a basic floor and a movable floor movable relative to said basic floor, arrangement for lifting and lowering of said movable floor relative to said basic floor, first and second lateral openings provided on opposite sides of said main box element;

a first secondary box element having a basic floor and a movable floor movable relative to said basic floor, arrangement for lifting and lowering said movable floor relative to said basic floor of the first secondary box element; and a second secondary box element having at least a basic floor;

whereby in said transportation state the second secondary box element being contained within said first secondary box element, to achieve said expanded state the second secondary box element being guided for movement out of the first secondary box element; in said expanded state a level of the movable floor of the main box element, a level of the movable floor of the first secondary box element and a level of the basic floor element of the second secondary box element are substantially identical, while a level of said basic floor of the main box element and a level of said basic floor of the first secondary box element remain stable, so that in said expanded state said first and second secondary box elements and said main box element form an enlarged room with an increased continuous floor area.

6. A mobile accommodation unit as claimed in claim 5, wherein said basic floor of said second secondary box element and said movable floor of said first secondary box element are formed with sealing ledges adapted for cooperation with adjacent complementary sealing ledges provided at said movable floor of the first secondary box element, so that in said expanded state said movable floor elements being lifted so that floor levels of said main box element, said first and second secondary box elements are substantially similar.

7. A container-type mobile accommodation unit as claimed in claim 5, wherein said second secondary box element is being guided for movement out of said first secondary box element through the respective lateral opening of said main box element.

8. A container-type mobile accommodation unit adapted for conversion from a retracted transportation state to an expanded state and visa versa, said unit comprising:

a main box element formed with at least a basic floor, a ceiling, first and second lateral openings provided on opposite sides thereof, a movable floor and arrangement for lifting and lowering said movable floor relative to the basic floor of the main box element between retracted, intermediate and extended positions, while keeping said respective basic floor stable;

a first secondary box element being independent from the main box element and formed with at least a basic floor and means for coupling and de-coupling of said basic floor to and from said first secondary box element;

a second secondary box element formed with at least a respective floor and a ceiling; and in said retracted transportation state said movable floor of the main box element is in said retracted position and said basic floor of the first secondary box element being de-coupled from said first secondary box element, said basic floor of the first secondary box element is supported by the movable floor of the main box element below a level of the floor of the second secondary box element, to achieve said expanded state said intermediate position of said movable floor of the main box element being selected in such a manner that the basic floor of the first secondary box element supported by the movable floor of the main box element contacts said first secondary box element after said second secondary box element is moved from the retracted transportation state into the expanded state, so as to facilitate coupling of the respective basic floor to said first secondary box element by said coupling means; and wherein said second secondary box element in said retracted transportation state being positioned within the first secondary box element, to achieve the expanded state said second secondary box element is being guided for a movement out of said first secondary box element and said main box element, so that in said expanded state said first and second secondary box elements and said main box element form an enlarged room with an increased continuous floor area.

9. A container-type mobile accommodation unit as claimed in claim 8, wherein said extended position of said movable floor of the main box element being selected in such a manner that upon said first secondary box element with the coupled respective basic floor being moved into the expanded state, a level of said movable floor of the main box element being positioned at a level of said floor of the second secondary box element and at a level of said basic floor of the first secondary box element so as to form a continuous floor between the main, the first secondary and second secondary box elements.

10. A container-type mobile accommodation unit as claimed in claim 9, therein said second secondary box element is being guided for movement out of said first secondary box element through the respective lateral opening of said main box element.

11. A mobile accommodation unit as claimed in claim 9, wherein said first secondary box element has a pair of opposite end walls formed with lower edges, a plurality of downwardly extending bushings provided at said lower edges, locking bolts having tapering tips extending through said bushings so as to be movably guided therein, said bushings having lateral openings adapted to retain locking balls, said basic floor of the first secondary box element carrying annular locking members aligned with said bushings, said annular locking members defining an inner wall are formed with recesses; and cam means provided at said end walls along said lower edges of said end walls for moving said locking bolts in response to actuating movement of said cam means, said locking bolts, upon engagement of said bushings with said annular locking members acting to push said locking balls partly out of said openings and into said recesses of said annular locking members, whereby said basic floor element of the first secondary box element upon engaging said lower edges is coupled with said first secondary box element.

12. A mobile accommodation unit as claimed in claim 11, and further comprising a plurality of rollers provided between said relatively movable floor elements.

* * * * *